US006077128A

United States Patent [19]

Maag et al.

[11] Patent Number: 6,077,128

[45] Date of Patent: Jun. 20, 2000

[54] PRESS-IN CONTACT

[75] Inventors: Arnulf Maag, Alsdorf; Wolfgang Neef, Freudenberg, both of Germany

[73] Assignee: Elco Europe GmbH, Betzdorf, Germany

[21] Appl. No.: 09/099,682

[22] Filed: Jun. 18, 1998

[30] Foreign Application Priority Data

Jun. 24, 1997 [DE] Germany ..... 197 26 759

[51] Int. Cl.[7] ..... H01R 13/42

[52] U.S. Cl. ..... 439/751; 439/82

[58] Field of Search ..... 439/82, 751, 84

[56] References Cited

U.S. PATENT DOCUMENTS

| | | | |
|---|---|---|---|
| 4,230,384 | 10/1980 | Anhalt | 439/751 |
| 4,606,589 | 8/1986 | Elsbee Jr. et al. | 439/751 |
| 4,857,018 | 8/1989 | Pickles | 439/82 |
| 5,004,426 | 4/1991 | Barnett | 439/82 |
| 5,564,954 | 10/1996 | Wurster | 439/82 |

FOREIGN PATENT DOCUMENTS 9004090 7/1990 United Kingdom .

OTHER PUBLICATIONS

DIN 41 611, Part 5, Sep. 1984, Lötfreie Elektrische Verbindungen.

*Primary Examiner*—Renee S. Luebke
*Assistant Examiner*—T. C. Patel
*Attorney, Agent, or Firm*—Friedrich Kueffner

[57] ABSTRACT

A press-in contact to be pressed into a throughplated hole of a printed circuit board includes a contact spring or a contact pin, a middle shaft portion connected to the contact spring or pin, and a connecting pin forming an extension of the middle shaft portion. The contact spring or the contact pin has in the transition area to the shaft portion a press-in shoulder. The shaft portion is provided with a slot-shaped opening whose sides are formed by legs. Each end of the slot-shaped opening has an approximately parabolic configuration. The slot-shaped opening is conically shaped and the end of the slot-shaped opening facing the contact spring or the contact pin extends into the area of the contact spring or the contact pin.

4 Claims, 1 Drawing Sheet

PRESS-IN CONTACT

BACKGROUND OF THE INVENTION

1. Field of the Invention

The present invention relates to a press-in contact to be pressed into a throughplated hole of a printed circuit board. The press-in contact includes a contact spring or a contact pin, a middle shaft portion connected to the contact spring or pin, and a connecting pin forming an extension of the middle shaft portion, wherein the contact spring or the contact pin has in the transition area to the shaft portion a press-in shoulder, the shaft portion is provided with a slot-shaped opening whose sides are formed by legs, and wherein each end of the slot-shaped opening has an approximately parabolic configuration.

2. Description of the Related Art

Press-in contacts of the above-described type are known in the art and serve to effect solder-free electrical connections which may correspond as so-called press-in connections to DIN 41611, part 5. Consequently, the press-in contact of the above-described type is of the type EE because the press-in portion of its shaft portion forming the actual press-in pin is constructed so as to be elastic, i.e., the forces necessary for the press-in connection are applied by the deformation of the elastic shaft portion and the printed circuit board which receives the press-in contact, as mentioned in Section 3.22 of DIN 41611, part 5.

A press-in contact of the above-described type is known from German utility model G 90 04 090.2. As compared to other well known press-in contacts, in the press-in contact of this type the making of the contact in a sleeve of a printed circuit board in the pressed-in state is improved by providing the slot-shaped opening at both ends thereof with the same parabolic configuration, while the opening has a reduced width portion in the middle thereof. This counteracts an excessive, non-uniform deformation of the legs forming the slot-shaped opening, so that the legs do not have to be realigned after the pressing-in process.

However, it has been found that the pressing-in process of the known press-in contact into the printed circuit board sleeve may lead to a hole wall deformation of the tin-coated copper sleeve. This has the disadvantage that the pressing-in may produce the so-called "jet effect", i.e., copper material and tin material are pulled into the sleeve. This may even have the result that copper layers are torn off, which is a result to be observed frequently when using multilayer printed circuit boards.

SUMMARY OF THE INVENTION

Therefore, it is the primary object of the present invention to provide a press-in contact of the above-described type in which an excessive hole wall deformation of the printed circuit board sleeve can be prevented.

In accordance with the present invention, the slot-shaped opening is conically shaped and the end of the slot-shaped opening facing the contact spring or the contact pin extends into the area of the contact spring or the contact pin.

The fact that the length of the slot-shaped opening extends into the contact spring or the contact pin means that the entire elasticity of the press-in contact is increased because the elasticity of the slot-shaped opening has an effect also outside of the hole of the printed circuit board, i.e., in the portion of the slot-shaped opening extending into the contact pin.

In accordance with the invention, the conical shape of the slot-shaped opening is such that the end of the opening extending into the contact spring or the contact pin is wider than the end facing the connecting pin, while the middle of the opening has a reduced width portion. Tests have shown that the configuration of the slot-shaped opening according to the present invention results in an increased elasticity of the press-in zone of the press-in contact because the conical slot-shaped opening is pressed together to a greater extent in the area of its reduced width portion when the press-in contact is pressed in. This results in a lower load acting on the printed circuit board sleeve and leads to the desired reduction of the pressing-in forces.

The present invention makes it possible to substantially improve the hole wall deformation, so that the jet effect described above, if it occurs et al., can only occur without harmful consequences. In spite of the high elasticity, the press-in contact is not damaged when being pressed in because the legs which define the slot-opening, which are convexly shaped at their outer sides, do not collapse in the direction toward the slot-shaped opening, so that they rest over their entire lengths against the hole wall of the sleeve and, thus, also ensure that a good contact is made.

In accordance with an advantageous further development of the present invention, the elasticity of the shaft portion is further increased by providing the legs forming the slot-shaped opening at the outer sides thereof with pressed-on elements which extend from the press-in shoulder to the area of the connecting pin. The tests have shown that, in spite of the increased elasticity of the press-in contact, the requirements concerning minimum holding force of 20 N according to IEC 352-5 are exceeded. Moreover, the tests have confirmed that a reliable electrical connection continues to exist even after a thermal load of 500 h at 105° C., which can be recognized by a stable transition resistance and the unchanged high holding forces.

It has also been found that the press-in contacts according to the present invention may have a substantially shorter structural length because of their good elasticity and, thus, are particularly suitable for printed circuit boards having a nominal thickness of 1.6 mm.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
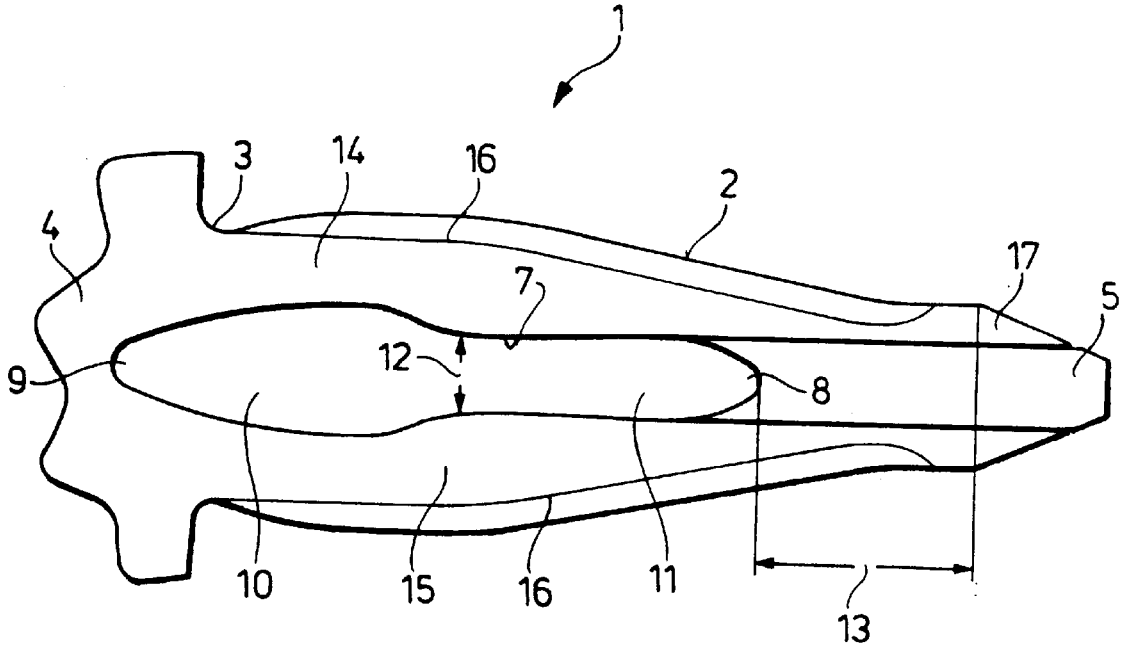
FIG. 1 is a schematic illustration of a press-in contact with a middle shaft portion manufactured on one side with a contact spring and on the other side with a connecting pin.
Figure 2:
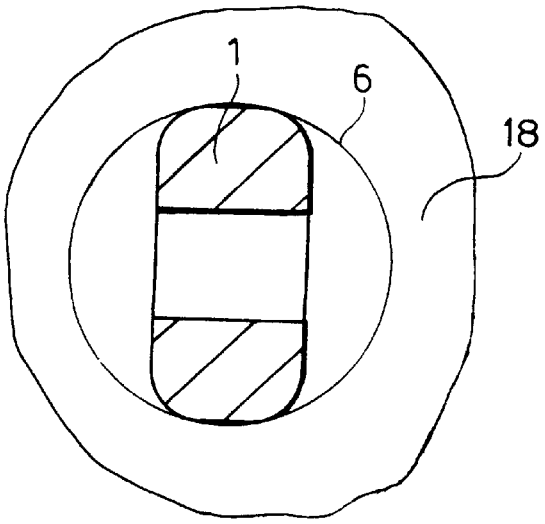
FIG. 2 is a side view, seen from the right hand side of FIG. 1, of the press-in contact pressed into a throughplated hole.

A press-in contact 1 shown in FIG. 1 to be pressed into a throughplated hole of a printed circuit board 18, shown in FIG. 2, includes a middle shaft portion 2 to which, as shown in the drawing, is connected a contact spring 4 through a press-in shoulder 3. Toward the front right end of the contact 1, the shaft portion 2 leads into a conical head piece 17 which tapers toward the front and receives a connecting pin 5.

The shaft portion 2 is provided with a conical slot-shaped opening 7 which extends into the area of the contact spring 4 and whose upper and lower or front ends 8,9 each have a parabolic shape.

The part 10 of the conical slot-shaped opening 7 facing the contact spring 4 and including the parabolically formed end 9 is wider than the other front part 11 which, approximately in the middle of the slot-shaped opening 7, has a reduced width portion 12 and then slightly expands again and then once again narrows toward the connecting pin 5. The parabolic end 9 of the slot-shaped opening facing the contact spring 4 extends into the contact spring 4 and, thus, is located outside of the printed circuit board once the contact has been pressed in. On the other hand, the other narrower end 8 of the slot-shaped opening 7 is located within the printed circuit board and ends at a distance 13 at the transition between the shaft portion 2 and the connecting pin 5.

The outer casing of the press-in contact 1 has on both sides of the slot-shaped opening 7 in the middle shaft portion 2 a leg 14 and 15 each. These legs 14 and 15 have a convex outer shape and are each provided over their lengths between the press-in shoulder 3 and the area of the connecting pin 5 with a pressed-on element 16 which ends above the head piece 17. As a result of the configuration and position of the slot-shaped opening 7 and the legs 14 and 15 with their pressed-on elements 16, the entire press-in contact 1 becomes more elastic which means, on the one hand, that the contact can be pressed in with reduced force while simultaneously having high holding forces and, on the other hand, that a hole wall deformation can be reduced. Moreover, a good contact continues to be made between the middle shaft portion 2 and the throughplated hole 6 in the printed circuit board 18.

While specific embodiments of the invention have been shown and described in detail to illustrate the inventive principles, it will be understood that the invention may be embodied otherwise without departing from such principles.

We claim:

1. A press-in contact adapted to be pressed into a throughplated hole of a printed circuit board, the press-in contact comprising a contact member, a middle shaft portion connected to the contact member, and a connecting pin forming an extension of the middle shaft portion, wherein the contact member has in a transition area thereof toward the middle shaft portion a press-in shoulder, wherein the middle shaft portion comprises legs defining a slot-shaped opening, wherein the slot-shaped opening has ends, the ends having an approximately parabolic configuration, wherein the end of the slot-shaped opening facing the contact member extends into the contact member, wherein the end of the slot-shaped opening facing the connecting pin is torpedo-shaped, and wherein the end of the slot-shaped opening facing the contact member has a greater width than the end facing the connecting pin, and wherein the slot-shaped opening has a reduced width portion between the two ends.

2. The press-in contact according to claim 1, wherein the contact member is a contact spring.

3. The press-in contact according to claim 1, wherein the legs defining the slot-shaped opening comprise pressed-on elements at outer sides thereof.

4. The press-in contact according to claim 3, wherein each pressed-on element extends from the press-in shoulder to the connecting pin.

* * * * *